US008936386B2

(12) United States Patent
Yang

(10) Patent No.: US 8,936,386 B2
(45) Date of Patent: Jan. 20, 2015

(54) DECORATIVE LAMP WITH LASER-ENGRAVING PATTERN

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 13/802,755

(22) Filed: Mar. 14, 2013

(65) Prior Publication Data

US 2014/0268669 A1 Sep. 18, 2014

(51) Int. Cl.
*H01R 33/00* (2006.01)
*F21V 31/04* (2006.01)

(52) U.S. Cl.
CPC ..... *F21V 31/04* (2013.01); *Y10S 362/806* (2013.01)
USPC ..... 362/641; 362/101; 362/253; 362/640; 362/806

(58) Field of Classification Search
CPC ..... H01R 3/00
USPC ..... 362/101, 253, 640, 641, 806
See application file for complete search history.

*Primary Examiner* — Evan Dzierzynski
*Assistant Examiner* — Meghan Dunwiddie
(74) *Attorney, Agent, or Firm* — Leong C. Lei

(57) ABSTRACT

A decorative lamp comprises a base, a light-emitting component, a transparent plastic housing, and a light-transmitting hollow column. The base is provided with an electrical connection portion for connecting to a public electrical source. The light-emitting component is mounted to a top of the base and electrically connected to the electrical connection portion of the base. The transparent plastic housing defines a bottom opening and a top opening and is provided with a laser-engraving pattern, wherein the housing is fixed to the base via the bottom opening thereof and accommodates the light-emitting component therein. The light-transmitting hollow column contains slightly-viscous flowable liquid therein and is securely fixed to the housing by providing a bushing at a bottom of the column and inserting the busing into the top opening of the housing.

6 Claims, 5 Drawing Sheets

DECORATIVE LAMP WITH LASER-ENGRAVING PATTERN

(a) TECHNICAL FIELD OF THE INVENTION

The present invention relates to a decorative lamp and, more particularly, to a decorative lamp with a laser-engraving pattern.

(b) DESCRIPTION OF THE PRIOR ART

Decorative lamps are an indispensable element for architectural decoration. In addition to the lighting function, decorative lamps are also used to complement a room for aesthetics. In view of existing decorative lamps, for creating a good visual effect, they often consume much electricity, as the housings that accommodate the light bulbs have a low transparency and thus require a high-power light bulb. For increasing the visual effect of a decorative lamp, a shaping method for a component thereof should be considered carefully. Thus, there is still room for improvement on the existing decorative lamps.

SUMMARY OF THE INVENTION

The primary object of the present invention is to provide a decorative lamp with a laser-engraving pattern, which can create a brilliant and colorful visual effect and consume less electricity.

To achieve the above object, the decorative lamp may comprise a base, a light-emitting component, a transparent plastic housing, and a light-transmitting hollow column. The base is provided with an electrical connection portion for connecting to a public electrical source. The light-emitting component is mounted to a top of the base and electrically connected to the electrical connection portion of the base. The transparent plastic housing defines a bottom opening and a top opening and is provided with a laser-engraving pattern, wherein the housing is fixed to the base via the bottom opening thereof and accommodates the light-emitting component therein. The light-transmitting hollow column contains slightly-viscous flowable liquid therein and is securely fixed to the housing by providing a bushing at a bottom of the column and inserting the busing into the top opening of the housing.

Other objects, advantages, and novel features of the present invention will become more apparent from the following detailed description when taken in conjunction with the accompanying drawings.

DETAILED DESCRIPTION OF THE PREFERRED EMBODIMENTS

To allow the features and advantages of the present invention to be fully understood, one embodiment is illustrated in the following paragraphs with reference to the accompanying drawings.

Figure 1:
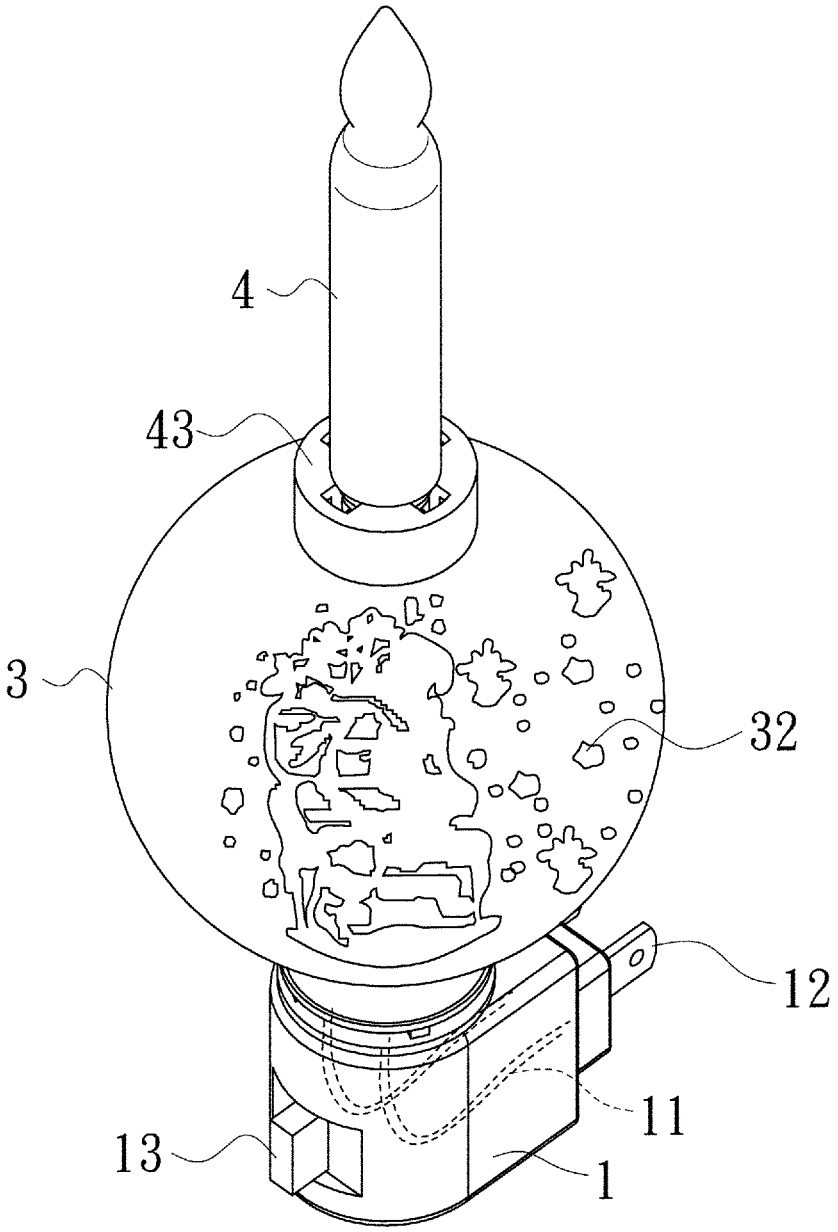
FIG. 1 shows a 3-dimensional view of one embodiment of the present invention.
Figure 2:
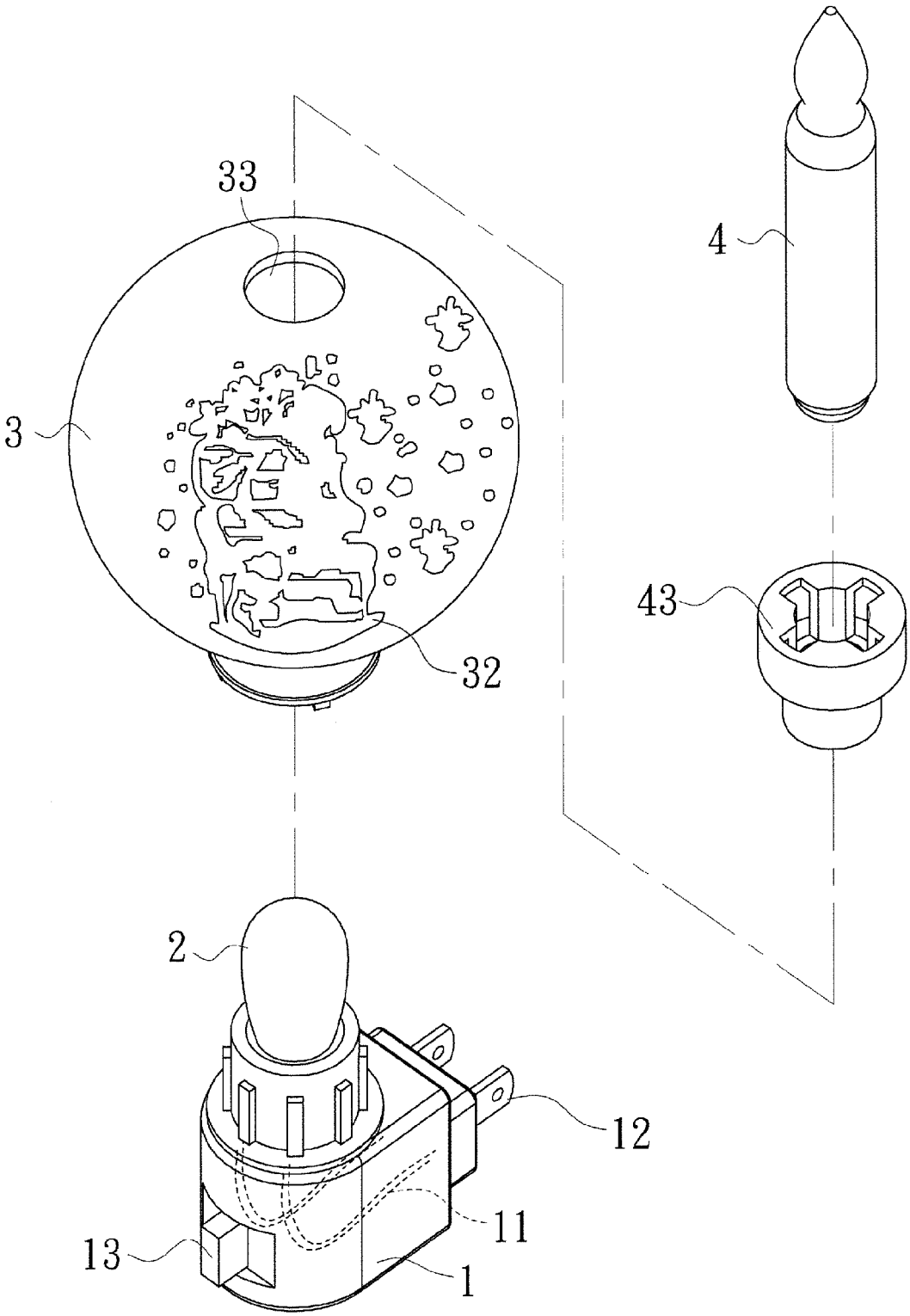
FIG. 2 shows an exploded view of the embodiment of the present invention.
Figure 3:
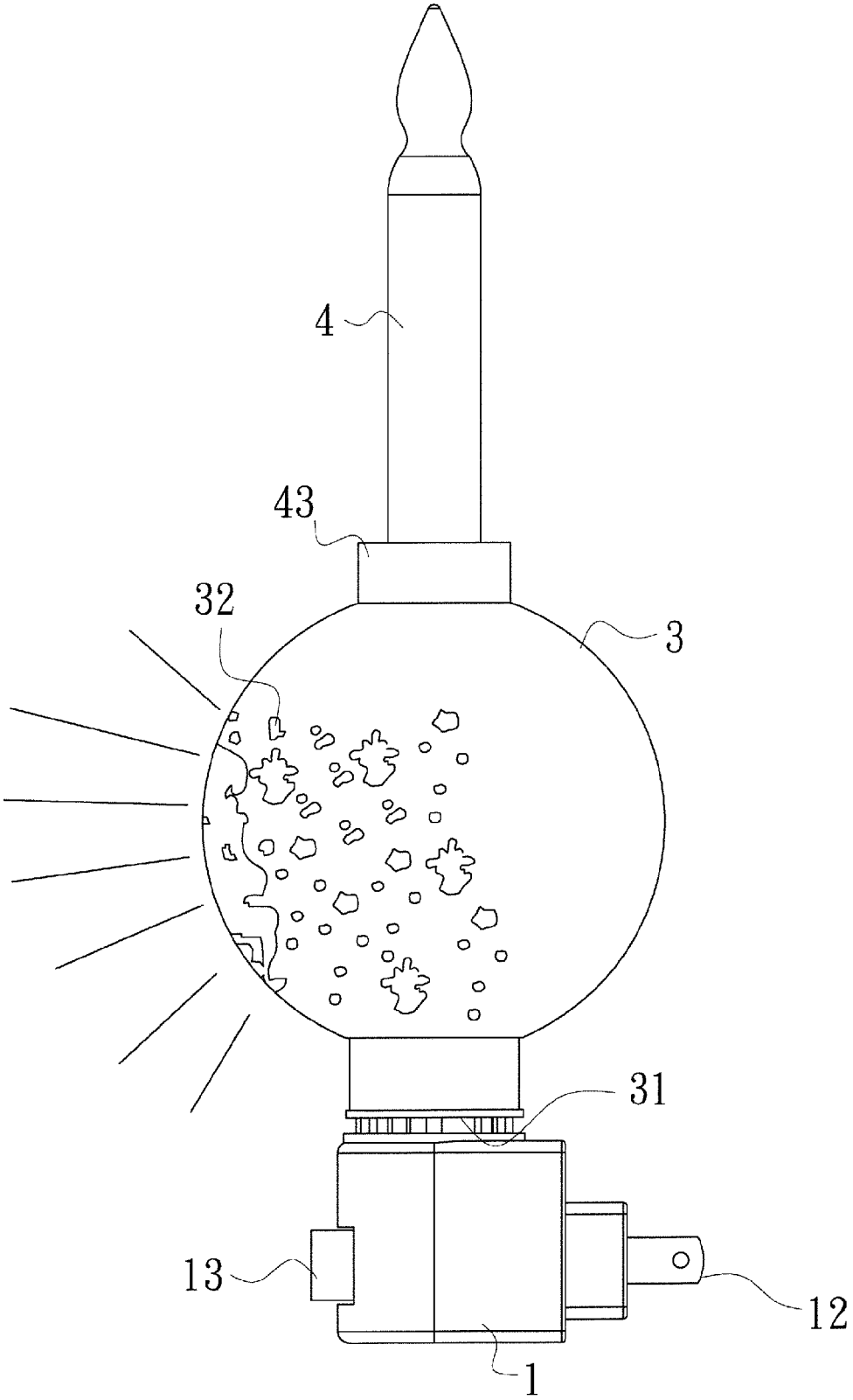
FIG. 3 shows a side view of the embodiment of the present invention.
Figure 4:
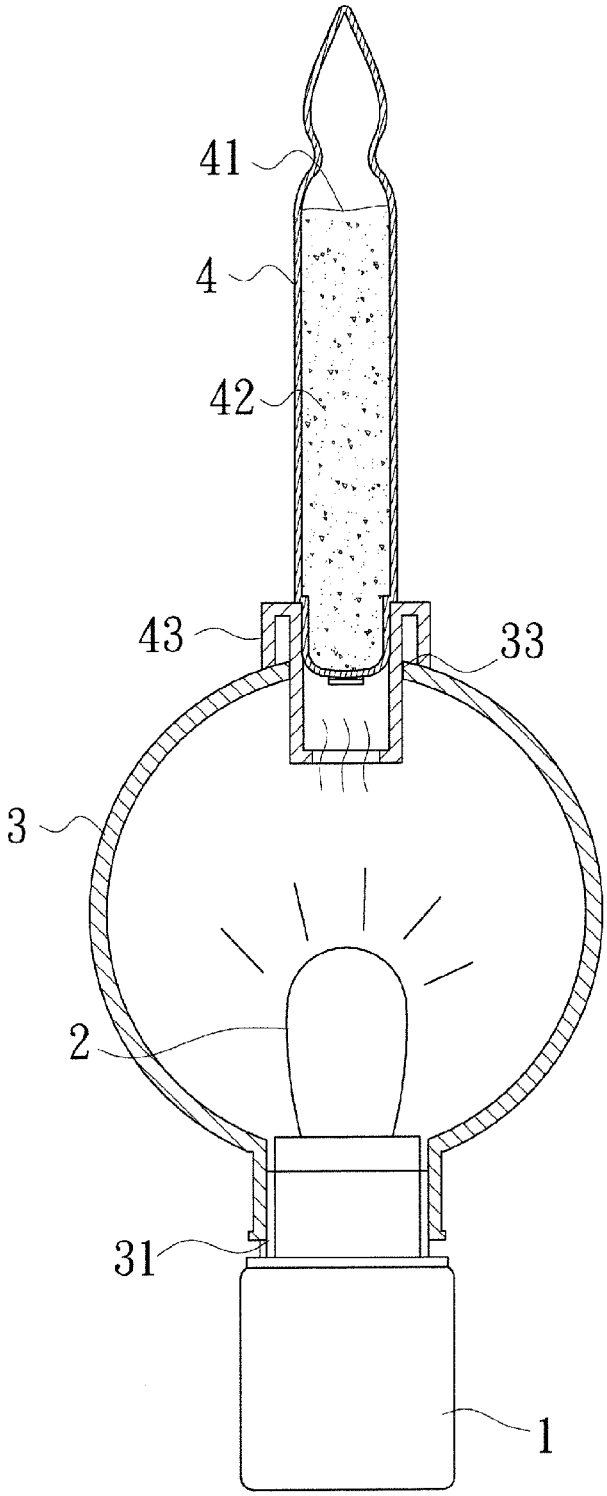
FIG. 4 shows a sectional view of the embodiment of the present invention.
Figure 5:
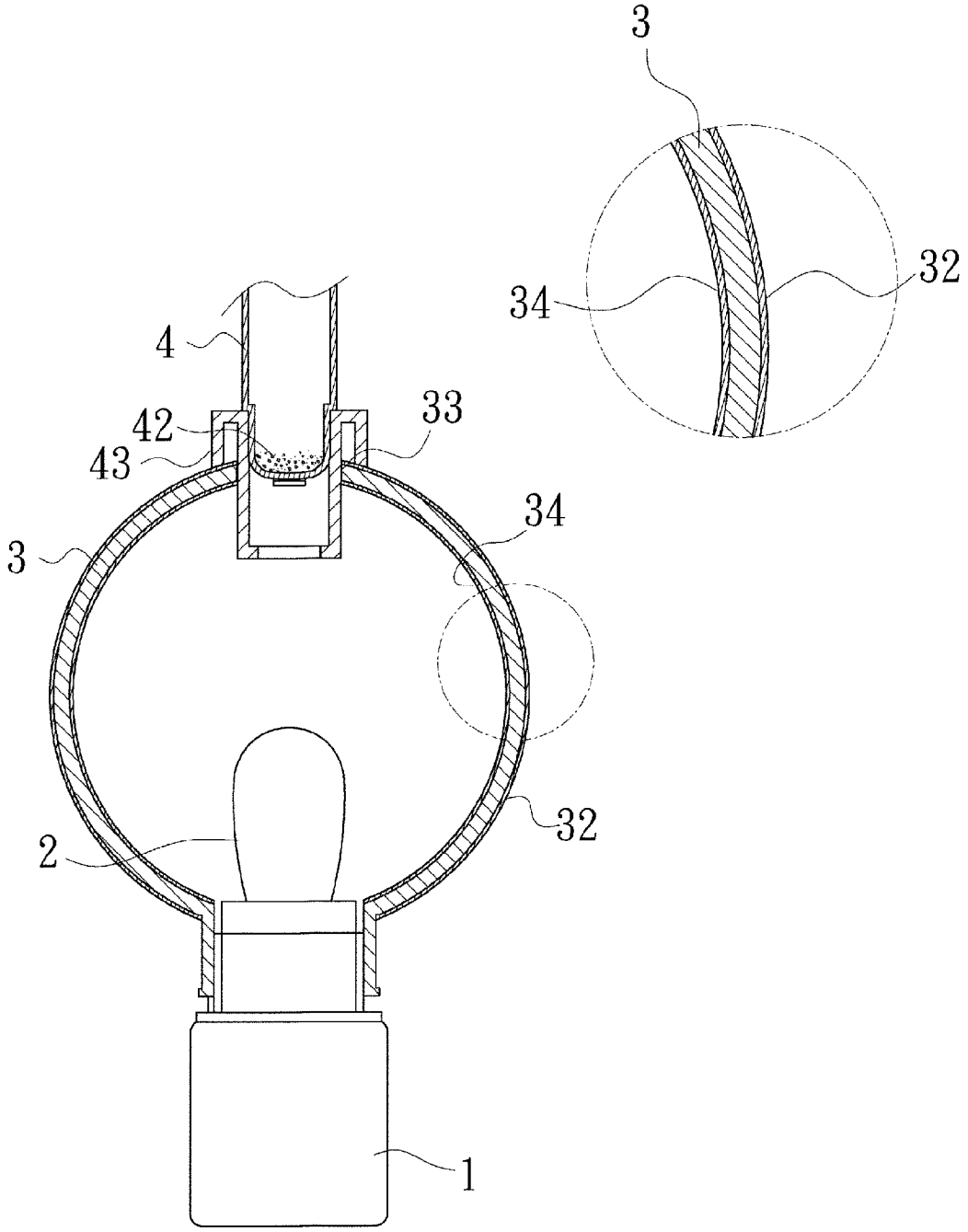
FIG. 5 shows an enlarged sectional view of the embodiment of the present invention, wherein the laser-graving pattern is provided at the outer surface of the transparent plastic housing.

Referring to FIGS. 1 through 5, a decorative lamp according to one embodiment of the present invention is shown, which generally comprises a base 1, a light-emitting component 2, a transparent plastic housing 3, and a light-transmitting hollow column 4.

The base 1 is provided with an electrical connection portion 12 for connecting to a public electrical source. The light-emitting component 2 is mounted to a top of the base 1 and electrically connected to the electrical connection portion 12 of the base 1 via a pair of electrical wires 11. The transparent plastic housing 3 defines a bottom opening 31 and a top opening 33 and provided with a laser-engraving pattern 32. The housing 3 is fixed to the base 1 via the bottom opening 31 thereof and accommodates the light-emitting component 2 therein. The light-transmitting hollow column 4, which contains slightly-viscous flowable liquid 41 therein, is fixed to the top opening 33 of the housing 3. Particularly, the light-transmitting hollow column 4 can be securely fixed to the housing 3 by providing a busing 43 at a bottom of the column 4 and inserting the busing 43 into the top opening 33 of the housing 3.

Furthermore, the base 1 can be provided with a switch 13 that is electrically connected between the electrical connection portion 12 and the light-emitting component 2, for turning on or off the light-emitting component.

In the embodiment, the light-transmitting hollow column 4 has a candle shape. The hollow column 4 contains liquid 41, which can be added with sequins 42 or glitter powders. When the light-emitting component 2 is turned on, the light emitting from the light-emitting component 2 can pass through the housing 3 to produce decorative light in the surrounding environment. Also, the heat generated by light-emitting component allows the liquid 41 contained in the hollow column 4 to flow, thereby moving the sequins 42 or glitter powders contained therein, so that a brilliant and colorful visual effect can be created.

The laser-engraving pattern 32 can be provided at an inner surface or an outer surface of the transparent plastic housing 3. To create a desired laser-engraving pattern at the inner surface of the housing 3, a corresponding pattern can be pre-formed on the inner surface of the housing 3 by using vacuum plating or coating, and then the corresponding pattern on the inner surface of the housing 3 can be engraved by using laser beam to form the desired laser-engraving pattern. Furthermore, the inner surface of the housing 3 can be coated with a colorful layer to give the housing a richer appearance. Furthermore, when the laser-engraving pattern 32 is provided at the outer surface of the transparent plastic housing 3, the opposite inner surface of the housing can be coated with a light-transmitting decorative layer 34, which can be formed from transparent adhesive being added with sequins or glitter powders, for creating abundant and layered visual effect.

Laser engraving is a practice that uses laser beam to engrave or mark an object. Various visual effects can be obtained by changing the intensity and spread of the laser beam. The painting or plating surface of the object can be vaporized by the laser beam to reveal the original color of its lower level. The present invention uses the laser techniques to create a pattern on the housing thereof, which can be cooperated with other components, to create an attractive visual effect and thus is an innovative creation.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A decorative lamp, comprising:

a base provided with an electrical connection portion for connecting to a public electrical source;

a light-emitting component mounted to the base and electrically connected to the electrical connection portion of the base;

a transparent plastic housing defining a bottom opening and a top opening and provided with a laser-engraving pattern, the housing being fixed to the base via the bottom opening thereof and accommodating the light-emitting component therein; and a light-transmitting hollow column containing slightly-viscous flowable liquid therein and fixed to the top opening of the housing.

2. The decorative lamp of claim 1, wherein the light-transmitting hollow column is securely fixed to the housing by providing a bushing at a bottom of the column and inserting the bushing into the top opening of the housing.

3. The decorative lamp of claim 1, wherein the base is provided with a switch electrically connected between the electrical connection portion and the light-emitting component for turning on or off the light-emitting component.

4. The decorative lamp of claim 1, wherein the laser-engraving pattern is provided at an inner surface of the transparent plastic housing.

5. The decorative lamp of claim 1, wherein the laser-engraving pattern is provided at an outer surface of the transparent plastic housing.

6. The decorative lamp of claim 5, wherein a light-transmitting decorative layer is provided at an opposite inner surface of the transparent plastic housing.

* * * * *